US011946247B2

(12) United States Patent
Reid et al.

(10) Patent No.: US 11,946,247 B2
(45) Date of Patent: Apr. 2, 2024

(54) RELATING TO FIRE RATED MOVEMENT JOINTS

(71) Applicant: TENMAT LIMITED, Manchester (GB)

(72) Inventors: Daniel Philip Reid, Manchester (GB); Ian Hainsworth, Leyland (GB); Rupert Coggon, Ludlow (GB)

(73) Assignee: TENMAT LIMITED, Manchester (GB)

( * ) Notice: Subject to any disclaimer, the term of this patent is extended or adjusted under 35 U.S.C. 154(b) by 0 days.

(21) Appl. No.: 18/087,747

(22) Filed: Dec. 22, 2022

(65) Prior Publication Data

US 2023/0332400 A1 Oct. 19, 2023

(30) Foreign Application Priority Data

Apr. 14, 2022 (GB) ..... 2205583.4

(51) Int. Cl.
*E04B 1/94* (2006.01)
*E04B 1/00* (2006.01)

(52) U.S. Cl.
CPC ..... *E04B 1/947* (2013.01); *E04B 1/948* (2013.01)

(58) Field of Classification Search
CPC ..... E04B 1/947; E04B 1/948
USPC ..... 52/232
See application file for complete search history.

(56) References Cited

U.S. PATENT DOCUMENTS 3,467,163 A * 9/1969 Vassaux ..... A62C 2/16 137/75
3,783,567 A * 1/1974 Ollis ..... E06B 3/68 52/204.591
4,125,979 A * 11/1978 McLaughlin ..... E04C 2/36 428/188
4,346,132 A * 8/1982 Cheng ..... E06B 3/285 160/84.01
4,756,945 A * 7/1988 Gibb ..... E04B 1/941 428/920
5,154,029 A * 10/1992 Sturgeon ..... E04F 13/12 52/95

(Continued)

FOREIGN PATENT DOCUMENTS

CA 3130352 A1 * 3/2022 ..... E04B 1/946

OTHER PUBLICATIONS

Examination Report of the United Kingdom Intellectual Property Office in related UK Appl. No. GB2205583.4, dated Jan. 5, 2023, 3 pages.

*Primary Examiner* — Brian D Mattei
*Assistant Examiner* — Joseph J. Sadlon
(74) *Attorney, Agent, or Firm* — Bochner PLLC; Andrew D. Bochner

(57) ABSTRACT

The present disclosure is directed toward a fire rated movement joint (100) for an internal compartment wall. The joint (100) comprises a wall track (112), a wall board (116) arranged at least partially overlapping the wall track (112) with a gap (124) therebetween, a fire barrier (132). The fire barrier (132) comprises an intumescent (126) and a scrim (134) enclosing the intumescent (126). The intumescent (126) is at least partly arranged within the gap (124) between the wall board (116) and the wall track (112), and the scrim (134) comprises a gusset (136) into which the intumescent (126) expands when reacting to heat.

17 Claims, 4 Drawing Sheets

(56) References Cited

U.S. PATENT DOCUMENTS 5,347,780 A * 9/1994 Richards ..... E06B 5/16 49/504
5,502,937 A * 4/1996 Wilson ..... B32B 15/20 52/273
5,968,615 A * 10/1999 Schlappa ..... E04B 1/948 52/786.13
6,058,668 A * 5/2000 Herren ..... E04B 2/825 52/236.7
6,216,404 B1 * 4/2001 Vellrath ..... E04B 2/7411 52/354
6,327,826 B1 * 12/2001 Mann ..... E06B 5/161 52/204.5
6,572,948 B1 * 6/2003 Dykhoff ..... E04B 1/948 428/920
6,698,146 B2 * 3/2004 Morgan ..... F16L 5/04 52/220.8
7,018,699 B2 * 3/2006 Dykhoff ..... B32B 9/007 52/273
7,152,385 B2 * 12/2006 Morgan ..... E04D 13/1656 52/317
7,424,793 B1 * 9/2008 Shriver ..... E04B 2/88 52/235
7,587,876 B2 * 9/2009 Bartlett ..... E06B 3/88 52/800.11
7,767,597 B2 * 8/2010 Garvey ..... B32B 27/10 428/920
7,775,006 B2 * 8/2010 Giannos ..... E04B 1/948 52/236.7
8,097,310 B2 * 1/2012 Miller ..... A62C 2/06 428/34.1
8,161,710 B2 * 4/2012 Elliott ..... F41H 5/04 89/36.01
8,230,659 B2 * 7/2012 Langille ..... E06B 5/161 52/213
8,484,916 B2 * 7/2013 Farag ..... B32B 17/10366 52/204.5
8,950,132 B2 * 2/2015 Collins ..... E04B 2/28 52/234
9,045,899 B2 * 6/2015 Pilz ..... E04B 2/58
9,458,628 B2 10/2016 Pilz et al.
9,512,614 B2 * 12/2016 Klein ..... E04B 1/948
9,637,886 B2 * 5/2017 Hawkinson ..... A01N 25/00
9,683,364 B2 * 6/2017 Pilz ..... E04B 1/948
9,909,298 B2 * 3/2018 Pilz ..... E04B 1/944
9,995,040 B2 * 6/2018 Stahl, Jr. ..... E04B 2/825
10,184,246 B2 * 1/2019 Pilz ..... E04B 2/7411
10,837,169 B2 * 11/2020 Ober ..... E04B 1/6806
10,914,065 B2 * 2/2021 Pilz ..... E04B 2/7414
11,111,666 B2 * 9/2021 Pilz ..... E04B 2/7409
11,162,259 B2 * 11/2021 Pilz ..... E04B 2/7457
11,598,088 B2 * 3/2023 Outram ..... E04B 1/942
2003/0079425 A1 5/2003 Morgan et al.
2006/0123723 A1 * 6/2006 Weir ..... E04H 4/0075 52/302.1
2006/0137293 A1 * 6/2006 Klein ..... E04B 2/7411 52/782.1
2007/0204540 A1 * 9/2007 Stahl ..... E04B 1/94 52/274
2009/0094912 A1 * 4/2009 Klein ..... E04B 2/7457 52/232
2010/0269449 A1 * 10/2010 Bush ..... A62C 2/06 428/312.6
2012/0124923 A1 * 5/2012 Goodman ..... E06B 5/164 52/232
2012/0297710 A1 * 11/2012 Klein ..... E04B 2/7457 52/514
2013/0061544 A1 * 3/2013 Stahl, Jr. ..... E04B 2/96 52/235
2013/0086857 A1 * 4/2013 Paetow ..... A62C 2/065 52/232
2014/0196391 A1 * 7/2014 Pilz ..... E04B 2/7411 52/232
2015/0135622 A1 * 5/2015 Muenzenberger ..... E04B 1/948 428/68
2015/0135631 A1 * 5/2015 Foerg ..... E04B 2/7411 428/68
2015/0275507 A1 10/2015 Klein et al.
2015/0275510 A1 * 10/2015 Klein ..... E04B 2/7411 52/232
2016/0017599 A1 1/2016 Klein et al.
2016/0097197 A1 4/2016 Pilz
2016/0201319 A1 7/2016 Pilz
2016/0208484 A1 7/2016 Pilz
2021/0032927 A1 * 2/2021 Brown ..... E04B 1/948
2022/0401767 A1 * 12/2022 Pilz ..... A62C 2/065

* cited by examiner

-- PRIOR ART --

-- PRIOR ART --

RELATING TO FIRE RATED MOVEMENT JOINTS

CROSS REFERENCE TO RELATED APPLICATION

This patent application claims the benefit and priority of GB Patent Application No. 2205583.4, filed on Apr. 14, 2022, the disclosure of which is incorporated by reference herein in its entirety as part of the present application.

FIELD OF THE INVENTION

The present disclosure relates to fire rated movement joints. In particular, the disclosure is concerned with fire rated movement joints for internal compartment walls which utilise intumescent material to prevent (or at least slow) a spread of fire.

BACKGROUND

A movement joint, sometimes termed an expansion joint, is a dynamic construction component that is designed to relieve or absorb movement between structural elements. Movement joints for building walls are typically designed with linear gaps which allow for a degree of movement between wall components to allow for construction movement, thermal movement, or seismic movement of the building; such movement may reduce or increase the size of the gap.

A fire rated movement joint is similarly designed to allow for relative movement between wall components, while also being designed to prevent the spread of fire between compartments separated by a wall via the movement joint (i.e., the gaps). In particular, fire rated movement joints are typically used within internal compartment walls which are constructed from plasterboard sheets fixed to either metal or timber frame works (studding), often referred to as dry walls, stud wall or partition walls. When such wall constructions form part of a fire rated compartment, then both the wall and joints between the wall and other parts of the construction—e.g., ceilings and load bearing walls—need to be fire tested to ensure that the whole construction will prevent the spread of fire as regulated by the construction codes and relevant test standards in each geographical area.

Typical applications of a fire rated movement gap within a dry wall construction are header tracks (between top of wall and ceiling), bottom tracks (between bottom of wall and floor) and also around the perimeter of the wall. The traditional approach to fire rated movement joints is to insert non-combustible mineral fibre between stud members or top and bottom members of a partition wall. This, however, relies upon the skill and time available for the installer to make a good quality fire seal, compressed to the correct compression, and is often found to be inadequate when inspected. Poor installation can readily result in not only a poor fire seal, but also impairing the function of the movement joint.

Recently, the traditional approach has been modified slightly to replace the non-combustible mineral fibre with a compressible intumescent material; intumescent solutions are generally faster to fit, require less skill to fit, are easier to inspect, and can seal larger gaps. In the related art, US 2016/0208484 A1, US 2016/0201319 A1, and U.S. Pat. No. 9,458,628 B2 are all examples of intumescent based fire-rated joint systems.

Whilst broadly an improvement over the traditional technique, one problem with such approaches is that they are prone to insulation failure, and so have limited performance. Moreover, current intumescent based approaches are not appropriate for protecting exposed steel work of the header/bottom tracks of a movement joint, requiring additional insulation to be fitted at significant extra time and cost.

Hence an improved approach to fire rated movement joints is highly desirable. The example embodiments have been provided with a view to addressing at least some of the difficulties that are encountered with current fire rated movement joints, whether those difficulties have been specifically mentioned above or will otherwise be appreciated from the discussion herein.

SUMMARY

The present invention is defined according to the independent claims. Additional features will be appreciated from the dependent claims and the description herein. Any embodiments which are described but which do not fall within the scope of the claims are to be interpreted merely as examples useful for a better understanding of the invention.

The present disclosure aims to provide a fire rated movement joint which seals off neighbouring compartments at an earlier stage of a fire, allows for large variation in gaps and movement of the wall in relation to the other construction members, combines compartment sealing and wall track insulation in a single product, avoids insulation failure from organic burn out, and is easy to fit and inspect.

Accordingly, in one aspect of the invention there is provided a fire rated movement joint for an internal compartment wall comprising a wall track, a wall board arranged at least partially overlapping the wall track with a gap therebetween, and a fire barrier comprising an intumescent (preferably spherical graphite) and a scrim enclosing the intumescent (preferably glass cloth reinforced with aluminium). The intumescent is at least partly arranged within the gap between the wall board and the wall track, and the scrim comprises a gusset into which the intumescent expands when reacting to heat. Beneficially, the position of the intumescent results in quicker reaction time to a fire to seal the movement joint, while also providing insulating char to protect the wall track so as to minimise heat conduction through this (usually metallic) component without resulting in a fire seal which is prone to an organic burn out spike.

The scrim provides support for the intumescent when it expands so that an insulating char formed on the surface of the intumescent cannot simply break away. This is particularly beneficial when the fire rated movement joint is at a top of a wall (i.e., the wall track is a "head of wall" track which runs along a ceiling) to counter the effects of gravity aiding possible breakage. Also, the scrim allows the intumescent to at least partially expand through it to allow for tight compression seals against surfaces to which the intumescent abuts once expanded. In some examples the scrim also comprises additional (one or more) anchor sections for attaching the scrim to at least one of a ceiling, a floor, or the wall track. In some examples, the gusset beneficially forces reverse expansion of the intumescent (at a later stage in the fire, after an initial forward expansion of the intumescent when reacting to the fire) in order to cause expansion towards the ceiling/floor (depending on where the barrier is positioned), so as to block gaps/channels around the ceiling/floor and wall track.

In a related aspect of the invention, there is also provided a fire barrier for use in a movement joint of an internal compartment wall.

BRIEF DESCRIPTION OF THE DRAWINGS

For a better understanding of the present disclosure reference will now be made by way of example only to the accompanying drawings, in which.

DETAILED DESCRIPTION

Figure 1:
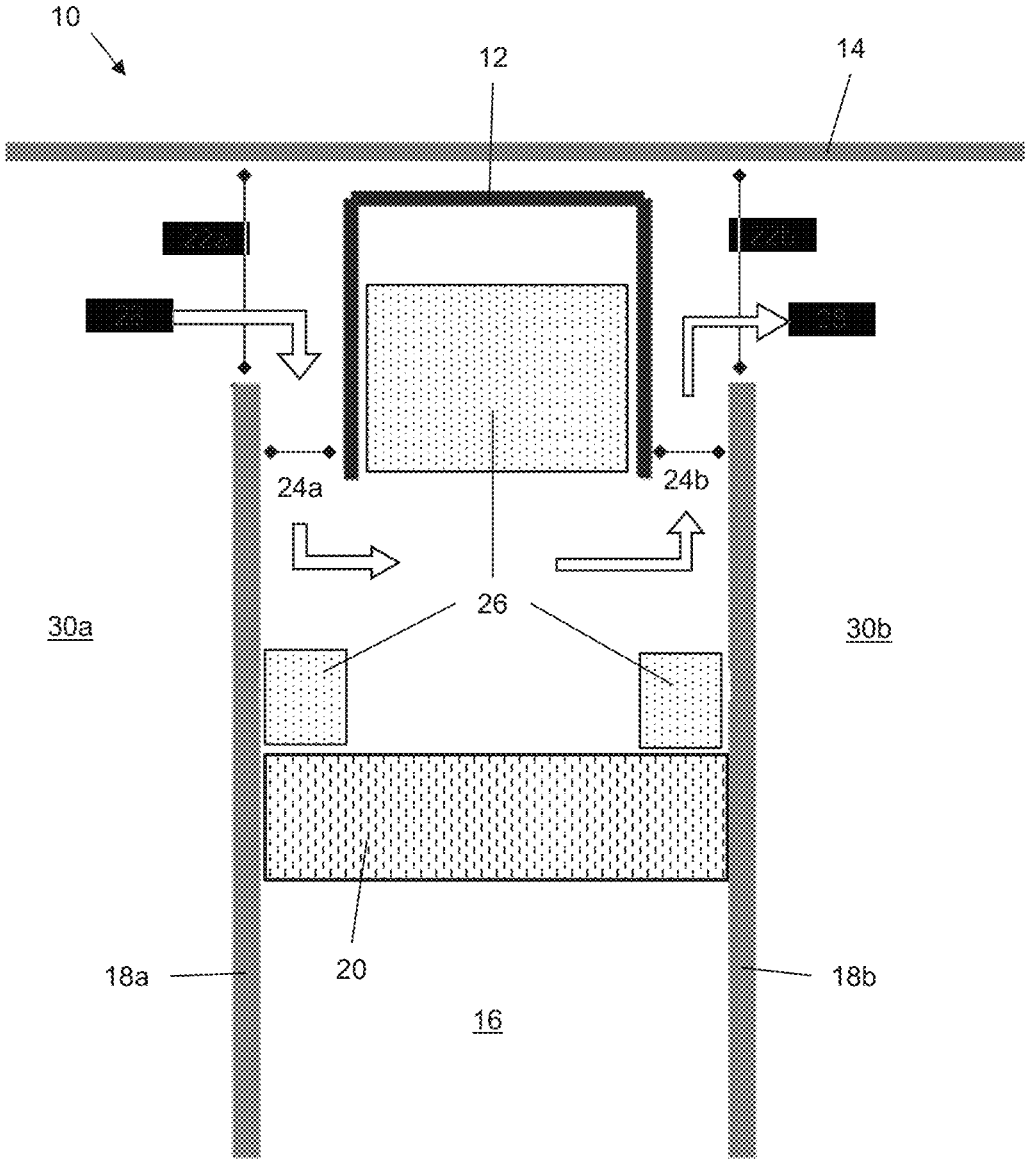
FIG. 1 shows a prior art fire rated movement joint substantially at installation.

FIG. 1 shows a prior art fire rated movement joint 10 for an internal compartment wall (only the top section of the wall is shown). The joint 10 is defined by the relation between a head of wall track 12, ceiling 14, wall 16 (comprising planarly aligned boards, or sheets, 18 and stud(s) 20), and gaps 22, 24 provided to allow for relative motion between the components: Gaps 22*a,b* are provided between the head of wall track 12 and wall boards 18*a,b*, respectively, while gaps 24*a,b* are provided between the wall boards 18*a,b* and the ceiling 14.

Intumescent material 26 is inserted inside the wall 16 in between the wall boards 18, stud 20, and head of wall track 12. In some implementations the intumescent material 26 is sandwiched between layers of compressible foam. In another implementation a mineral fibre is impregnated with intumescent material. The chosen intumescent material is typically spherical graphite.

Figure 2:
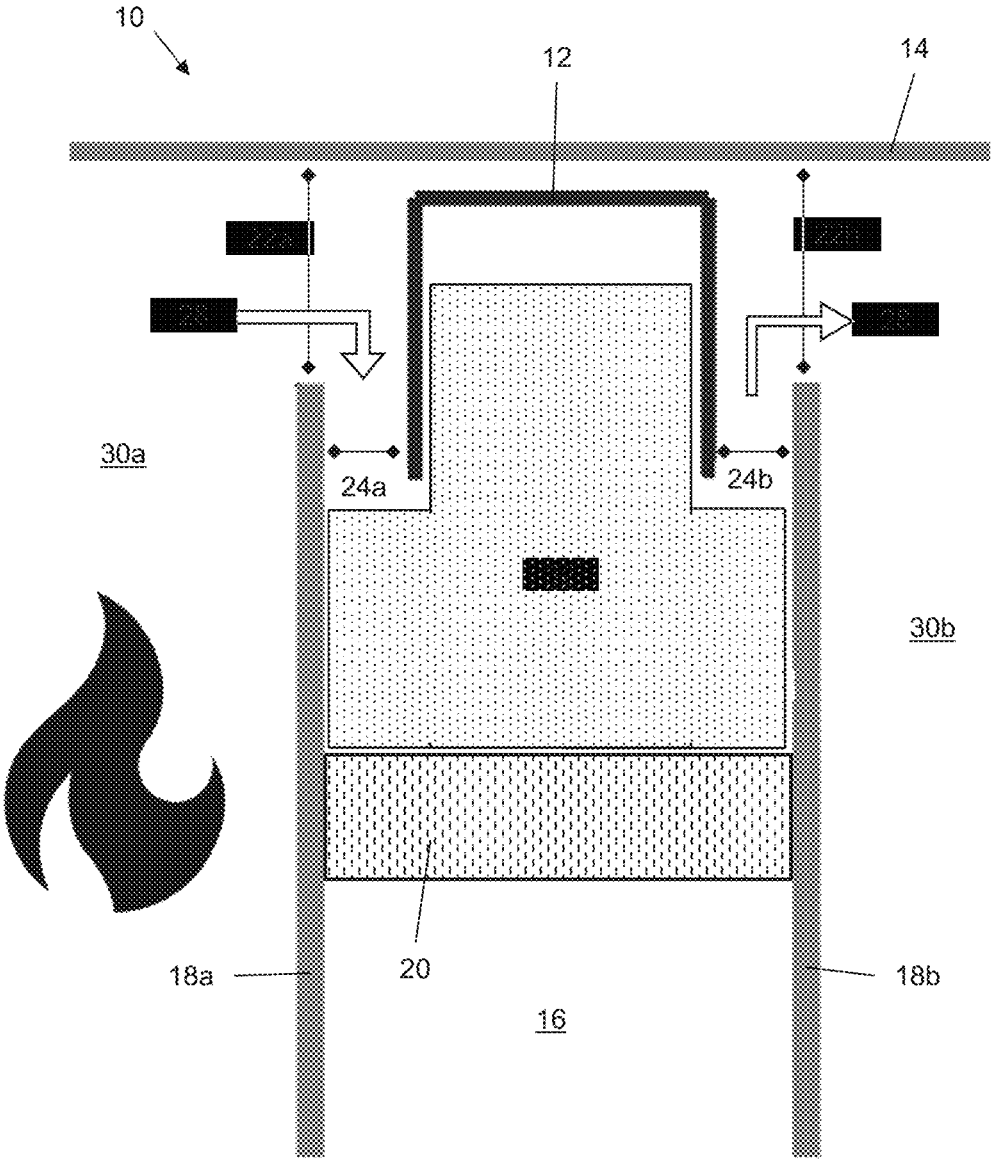
FIG. 2 shows a prior art fire rated movement joint during a fire.

As demonstrated by FIG. 2, in a fire situation the intumescent material 26 expands to fill the internal space of the wall 16 to close a channel 28 joining compartments 30*a* & 30*b* via the gaps 22, 24 and wall 16, thereby forming a fire seal 32.

Almost all intumescent materials contain some amount of organic compounds (often rubber based) as well as an active (expansion causing) ingredient such as spherical graphite. When exposed to fire, the organic compounds combust which leads to an organic burn out spike in the temperature on the cold face of a fire seal (i.e. the face away from the fire). Thus heat may be transferred across the fire seal from the hot to the cold face: this is what's known as insulation failure.

Insulation failure from an organic burn out spike is particularly problematic in the area around the head of wall track 12, due to the usually metallic construction of the head of wall track 12. The (failed) fire seal 32 will aid in conduction of heat between the hot and cold faces of the head of wall track 12 which, as an already good thermal conductor, greatly increases the risk of the fire spreading across compartments.

Improving the Fire Seal

Figure 3:
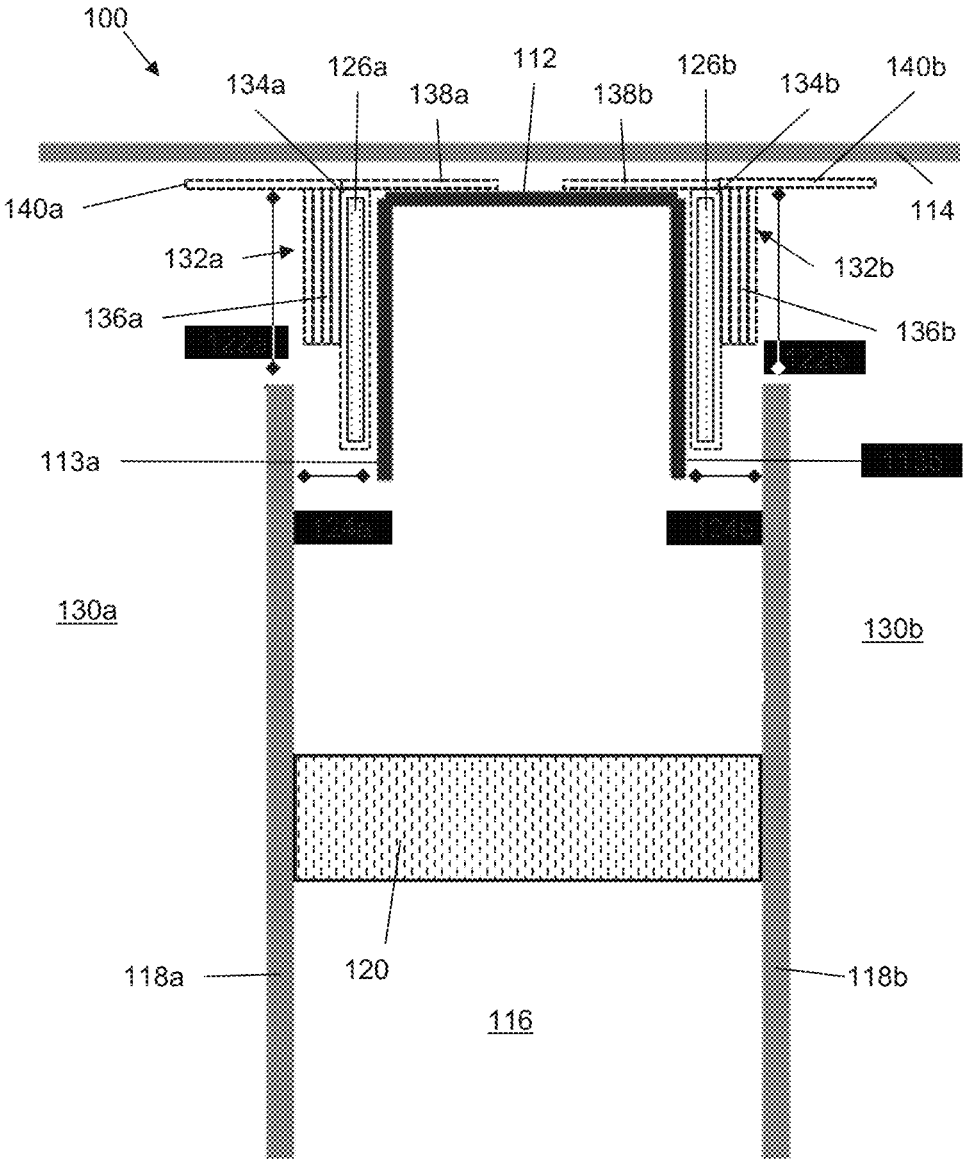
FIG. 3 shows an example improved fire rated movement joint.

FIG. 3 shows an improved fire rated movement joint 100 (as applied to a header section of a partition). As with the prior art example, the joint 100 is defined by the relation between a head of wall track 112, ceiling 114, a wall 116, and gaps 122, 124 provided to allow for relative motion between the components.

Generally, the wall 116 may be any kind of wall suitable for use in a movement joint. Consistent with the prior art example, here the example wall 116 is a stud/partition/dry wall that comprises two boards 118*a,b* aligned (vertically) perpendicular to the ceiling 114. The wall 116 may be secured to a building superstructure via a floor of the building, leaving the top (i.e., part proximate to the ceiling 114) floating to form part of the movement joint 100. Studs 120 may be provided to secure board 118*a* to board 118*b*. The boards 118*a,b* may be formed of plaster board or other suitable construction material, and may even be of different construction materials. In some examples, the wall 116 may only comprise one board 118*a*, such as when the wall 116/movement joint 100 is being used in conjunction with a sturdier construction wall, such as a breezeblock or brick (e.g., outer) wall.

The head of wall track 112 is provided along the ceiling 114 by suitable securing means such as adhesive, nuts and bolts, etc. The track 112 is configured to fit within a cavity of the wall 116 defined by the internal separation of the boards 118*a,b* so that the track 112 locates the top of the wall 116 to the ceiling; or put another way, the wall boards 118*a,b* overlap the head of wall track in the (vertical) plane of the wall 116 (so that the head of wall track 112 stops any horizontal motion causing the wall to fall over). The head of wall track 112 is provided in a U shape to limit heat conduction from one compartment facing surface 113*a* to the opposite compartment facing surface 113*b*, and is preferably made from steel or some other robust metal.

Gaps 122*a,b* are provided between the head of wall track 112 and wall boards 118*a,b*, respectively, while gaps 124*a,b* are provided between the wall boards 118*a,b* and the ceiling 114. The gaps 122, 124 are typically small, on the order of millimetres of centimetres, but are sufficiently sized to allow for the expected variation in ceiling 114/head of wall track 112/wall 116 motion from e.g., thermal expansion, seismic movement, and so on.

A fire barrier 132 is provided which is designed to seal the gaps 122, 124 during a fire situation. In this example, two essentially identical, but oppositely oriented, fire barriers 132*a,b* are provided which are able to act separately to close off the left (a labels) and right (b labels) sides of the movement joint 100. In a fire situation, one or both of the fire barriers 132 deploy to create a seal, depending on the extent the fire; e.g., proximity, temperature, and so on. The fire barrier is positioned on a surface of the head of wall track 112 which is exposed to a compartment 130, making the fire barrier easy to fit and inspect. Importantly, the fire barrier 132 so positioned in its undeployed state does not prevent the function of the movement joint 100; that is, the gaps 122, 124 remain at least partly open and therefore functional when the barrier 132 is installed but undeployed.

The fire barrier 132 comprises an intumescent material 126, preferably in the form of a thin strip as will be familiar to those in the art. The intumescent 126 is provided on an exterior (i.e., compartment facing) section of the head of wall track 112. More specifically, for the barrier 132*a*, the intumescent material 126*a* is arranged on the compartment facing surface 113*a* in such a way that the intumescent material 126 is at least partly within the gap 124*a* between the board 118*a* and head of wall track (/surface 113*a*). Similarly, for the barrier 132*b*, a strip of intumescent material 126*b* is arranged on the compartment facing surface 113*b* at least partly within the gap 124*b* between the board 118*b* and head of wall track 112 (/surface 113*b*). Intumescent materials expand in a linear fashion when exposed to heat, and so suitably the intumescent 126*a,b* is provided such that its direction of expansion is towards the gap 122*a,b*.

The fire barrier 132 also comprises a scrim 134 (i.e., a net like structure with small holes in it) enclosing the intumescent material 126. The scrim 134 is preferably formed from glass cloth of the sort that will be familiar to those in the art. In some examples the scrim 134 comprises a reinforcement layer, which provides the scrim 134 with greater flexibility to move without breaking compared to a scrim without reinforcement. Preferably the scrim 134 is reinforced with aluminium, although other suitably malleable metals could also be used.

In one example, enclosing the intumescent 126 comprises wrapping (i.e., encasing) the intumescent 126 in the scrim 134 (prior to, or during, installation in the movement joint 100) so that the scrim 134 is in contact with the head of wall track 112 and attached thereto, and the intumescent 126 is attached to the scrim 134. In another example, enclosing the intumescent 126 comprises covering the intumescent 126 in the scrim after the intumescent 126 has been attached to the head of wall track 112. In other words, a back surface of the intumescent 126 (or at least a part thereof) may be directly contactable with the head of wall track 112 and attached thereto, while the remaining (otherwise exposed) surfaces of the intumescent are covered in scrim 134. The scrim 134 in this example may be suitably attached directly to the intumescent 126 and/or head of wall track 112.

Attaching the scrim 134 and/or intumescent 126 (to each other and/or the head of wall track 112) may be achieved through suitable means such as adhesive, spikes/nails, nuts & bolts, and so on, as will be familiar to those in the art. If an adhesive is used, it is desirable to use an adhesive with a melting temperature above the temperature at which the intumescent 126 reacts to heat.

The scrim 134 comprises a gusset 136, or otherwise pleated section—i.e., a section of the scrim 134 that is folded in/over on itself at least once, and preferably several times—which allows for expansion of the intumescent (during a fire).

The gusset 136 is provided in a part of the scrim that is not directly attached to the head of wall track 112. The gusset 136 is preferably provided on a part of the scrim 134 that is in the direction in which the intumescent 126 will expand. Suitably, in this example, the gussets 136*a,b* are provided in a section of the respective scrim 134*a,b* that faces the respective gap 122*a,b*.

A shape of the gusset 136 (preferably substantially two dimensional along a surface of the scrim 134) may be maintained by applying adhesive to the gusset 136 (e.g., between folds of the gusset), so that it does not inadvertently open, or billow, after installation of the fire barrier 132. In such an example the adhesive used to seal the gusset 136 closed should have a melting temperature substantially the same as, or just below, the reaction temperature of the intumescent 126. The type of adhesive used can be readily varied to allow for use of the fire barrier at different temperatures (e.g., specifically adapted for different types of fire).

In some examples, the scrim also comprises one or more anchor sections 138, 140, which is a part of the scrim 134 pressed to be substantially two dimensional (i.e., leaf like) and which provide additional attachment points to support the scrim 134 in its position in the movement joint 100. A first anchor section 138 may be provided which is attached to both the head of wall track 112 and ceiling 114; put another way, the first anchor section 138 may be pinched between the wall track 112 and ceiling 114. A second anchor section 140 may be provided which extends in an opposite direction to the first anchor section 138—i.e., away from the head of wall track 112—which may be suitably attached to the ceiling 114 to provide another anchor area. Moreover, in example implementations with a second anchor section, the gusset 136 may be provided as an extension of the second anchor section 140—i.e., down from the ceiling. As before, the anchor sections 138, 140 may be attached to the ceiling 114/wall track 112, as appropriate, by suitable means such as adhesive, spikes/nails, nuts & bolts, and so on; if an adhesive is used, it is desirable to use an adhesive with a melting temperature above the temperature at which the intumescent 126 reacts to heat.

Figure 4:
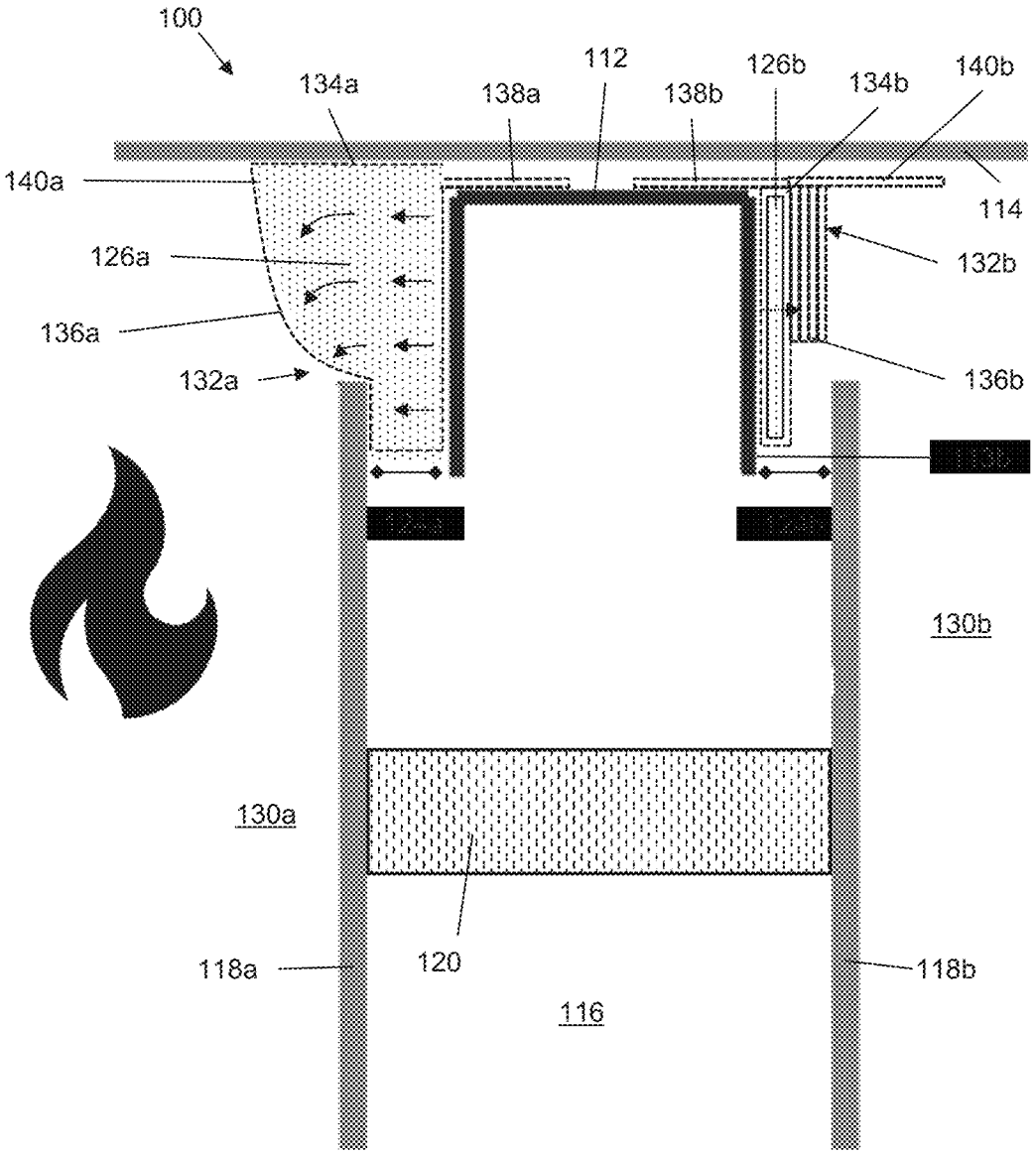
FIG. 4 shows an example improved fire rated movement joint during a fire.

FIG. 4 shows the fire rated movement joint 100 in a fire situation, specifically a fire in compartment 130*a*.

When the fire causes the intumescent 126*a* to reach its reaction temperature, the intumescent expands (in a generally linear fashion). The part of the intumescent 126 which was positioned within the gap 124*a* expands until it hits the wall board 118*a*, and compresses against it, thereby sealing the gap 124*a*, and so preventing the flow of smoke, hot air, and potentially combustible material through the movement joint 100 to compartment 130*b*.

The part of the intumescent 126 not confined within the gap 124*a* expands into the gap 122*a*. While the majority of the expansion is at first directly outward away from the track 112, there is also some nonlinear expansion, meaning the intumescent also rises up to the ceiling and blocks any possible channel between compartments 130*a,b* via any gaps between the head of wall track 112 and ceiling 114. Also, the weight of the intumescent which expands into gap 122*a* causes the angle of expansion to change downwards towards the floor of the compartment. This exposes more of the intumescent 126 to the fire which is beneficial in creating additional surface for insulating char. The 'downward' expansion is also aided by the fact that the part of the intumescent in the gap 124*a* is somewhat shielded from the fire by the wall board 118*a*, and so there is a temperature difference between the top and bottom of the intumescent which causes the top (expanding into gap 122*a*) to expand faster.

The gusset 136*a* provides room in the scrim 134 for the intumescent 126 to expand into the compartment 130*a* (e.g., via a concertina effect), while still allowing the scrim 134 to support the intumescent 126 to keep it protecting the movement joint 100. Without the scrim 134, there is a possibility that the intumescent 126, in particular the insulating char surface, could break apart where it is has expanded through gap 122 into compartment 130 due to a lack of support. A size of the gusset 136 (i.e., the amount of expansion space in the scrim 134 the gusset 136 provides, possibly based on a number of folds in the gusset 136) is based on a degree to which it is desired to allow the intumescent to expand so as to allow the change in angle past the wall board 118*a* to take place, and so may be suitably adapted for use in a specific movement joint (e.g., specific arrangements/separations of walls, head of wall tracks, ceiling). In general, a larger expanded intumescent pocket 126 provides higher thermal insulation than a smaller one. Also, if insufficient space is provided in the gusset 136 then the scrim 134 may split and stop providing support for the insulating char.

While the gusset 136 initially allows space for expansion of the intumescent, eventually the gusset 136 begins to constrain the intumescent 126 as it expands towards the floor. At this stage, continued expansion of the intumescent 126 (as it continues to react to the fire) results in the direction of expansion reversing course back towards the ceiling, further aiding in ceiling any gaps/channels between compartments 130*a* and 130*b* at the ceiling 114. Put another way, once the gusset 136 has been filled by intumescent 126 from 'normal' forward expansion, the gusset 136 beneficially forces the intumescent 126 to be pushed backwards towards the ceiling 114; it will be appreciated that such beneficial reverse expansion would not be achievable with conventional fire barriers. The choice of gusset 136 size therefore similarly adjusts the degree to which reverse expansion of the intumescent may be achieved to seal ceiling gaps. Put another way, the gusset 136 is suitably sized for a given intumescent to force reverse expansion of the intumescent at some stage in the fire after an initial forward expansion of the intumescent into the gusset 136.

The intumescent 126 also expands partially through the small holes in the scrim 134, which ensures a tight seal wherever the intumescent 126 pushes up against another surface (e.g., at the wall board 118*a*, or ceiling 114). Put another way, the choice of scrim 134 is based upon selecting a scrim with sufficiently small holes so that the scrim 134 provides good reinforcement, but not so small that the intumescent 126 can't expand through the holes. In the case where the scrim 134 is reinforced, the reinforcement layer beneficially burns away leaving the scrim 134 intact and allowing the expansion of the intumescent through the scrim 134.

The position of the fire barrier 132 on the outer surface of the head of wall track 112, exposed to the gap 122, results in the intumescent 126 heating up to reaction temperature sooner than prior art techniques which put the intumescent within the wall cavity; thus the channel between compartments through the movement joint is sealed at an earlier stage of a fire (thereby improving the fire rating of the joint 100).

Moreover, the expanded intumescent 126 acts as heat insulation, thereby better shielding the (usually steel) head of wall track 112 from the fire and minimising the possibility of heat conduction from the hot side of the wall track 112 to the cold side. Beneficially the need for separate insulation to protect the head of wall track is negated.

It will also be readily apparent that the seal created by the fire barrier 132 does not join the hot and cold sides of the head of wall track 112 or cavity wall 116. Thus there is no risk of an organic burn out spike causing insulation failure of the fire seal.

While the above examples have focused on a movement joint 100 at the top of a wall separating two internal compartments of a building, it will be readily appreciated that the above techniques could be applied to other arrangements of movement joint. For example, where the movement joint is used at a perimeter of a single compartment, not a joint between two compartments, only a single fire barrier 132*a* may be required (e.g., only the left hand side 'a' numerals of FIGS. 3 & 4 is present). Also, the above description may be readily applied to a movement joint provided around a bottom of wall track instead of a head of wall track.

In summary then, exemplary embodiments of an improved fire rated movement joint, and more specifically a new form of fire barrier used therein, have been described.

The fire barrier for the fire rated movement joint may be manufactured industrially. An industrial application of the example embodiments will be clear from the discussion herein.

Although preferred embodiment(s) of the present invention have been shown and described, it will be appreciated by those skilled in the art that changes may be made without departing from the scope of the invention as defined in the claims.

Attention is directed to all papers and documents which are filed concurrently with or previous to this specification in connection with this application and which are open to public inspection with this specification, and the contents of all such papers and documents are incorporated herein by reference.

All of the features disclosed in this specification, and/or all of the steps of any method or process so disclosed, may be combined in any combination, except combinations where at least some of such features and/or steps are mutually exclusive.

Each feature disclosed in this specification may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification, or to any novel one, or any novel combination, of the steps of any method or process so disclosed.

The invention claimed is:

1. A fire rated movement joint for an internal compartment wall, comprising:

a wall track;

a wall board arranged at least partially overlapping the wall track with a gap therebetween;

a fire barrier comprising an intumescent strip and a scrim enclosing the intumescent strip, wherein the intumescent strip is at least partly arranged within the gap between the wall board and the wall track, and the scrim comprises a gusset into which the intumescent strip expands when reacting to heat.

2. The fire rated movement joint of claim 1, wherein the fire barrier is positioned on a surface of the wall track proximate to a gap provided between the wall board and ceiling or between the wall board and floor.

3. The fire rated movement joint of claim 1, wherein the scrim allows for at least partial expansion of the intumescent strip through the scrim.

4. The fire rated movement joint of claim 1, wherein the gusset is sized to force reverse expansion of the intumescent strip after an initial forward expansion of the intumescent strip into the gusset.

5. The fire rated movement joint of claim 1, wherein the scrim is formed from glass cloth.

6. The fire rated movement joint of claim 1, wherein the scrim comprises a reinforcement layer.

7. The fire rated movement joint of claim 6, wherein the reinforcement layer is aluminium.

8. The fire rated movement joint of claim 1, wherein at least one of the scrim and intumescent strip are attached to the wall track.

9. The fire rated movement joint of claim 8, wherein the at least one of the scrim and intumescent strip attached to the wall track are attached by adhesive with a melting temperature above the temperature at which the intumescent strip reacts to heat.

10. The fire rated movement joint of claim 1, wherein the gusset is provided in a part of the scrim that is not directly attached to the wall track.

11. The fire rated movement joint of claim 1, wherein a shape of the gusset is maintained by adhesive with melting temperature substantially the same as the reaction temperature of the intumescent strip.

12. The fire rated movement joint of claim 1, wherein the scrim comprises one or more anchor sections for attaching the scrim to at least one of a ceiling, a floor, or the wall track.

13. The fire rated movement joint of claim 12, wherein a first of the one of more anchor sections is secured between the wall track and ceiling or floor.

14. The fire rated movement joint of claim 13, wherein a second of the one or more anchor sections is secured to the ceiling or floor.

15. The fire rated movement joint of claim 1, wherein the wall board forms one side of a wall cavity, and the wall track is configured to fit within the wall cavity.

16. The fire rated movement joint of any preceding claim, wherein the wall board is plasterboard.

17. The fire rated movement joint of any preceding claim, wherein the wall track is substantially U shaped.

* * * * *